United States Patent [19]

De Luca

[11] Patent Number: 4,679,703

[45] Date of Patent: Jul. 14, 1987

[54] DEVICE FOR PREVENTING NAPKINS FROM BUNCHING AT THE DISPENSING OPENING IN A PAPER NAPKIN DISPENSER

[75] Inventor: Raymond F. De Luca, Samford, Conn.

[73] Assignee: Georgia-Pacific Corporation, Atlanta, Ga.

[21] Appl. No.: 585,538

[22] Filed: Mar. 2, 1984

[51] Int. Cl.[4] ..... A47K 10/24; B65H 1/00

[52] U.S. Cl. ..... 221/52; 221/53; 221/59; 221/63

[58] Field of Search ..... 221/52, 59, 63, 58, 221/35, 53

[56] References Cited

U.S. PATENT DOCUMENTS

| | | | |
|---|---|---|---|
| 2,027,670 | 1/1936 | Broeren . | |
| 2,138,692 | 11/1938 | Broeren et al. . | |
| 2,434,206 | 1/1948 | Frieders . | |
| 2,522,427 | 9/1950 | Borden . | |
| 2,563,693 | 8/1951 | Russell . | |
| 2,852,158 | 9/1958 | Jones et al. | 221/59 X |
| 2,858,045 | 10/1958 | Loeb | 221/59 |
| 3,071,289 | 1/1963 | Taylor | 221/59 |
| 3,589,555 | 6/1971 | Burkhalter . | |
| 3,726,435 | 4/1973 | Williams et al. . | |

*Primary Examiner*—Joseph J. Rolla
*Assistant Examiner*—David H. Bollinger
*Attorney, Agent, or Firm*—Banner, Birch, McKie & Beckett

[57] ABSTRACT

A device for preventing napkins from bunching at the dispensing opening in a napkin dispenser. A pair of pressure relief rods are provided along the upper and lower portions of the dispenser face plate to relieve pressure between the face plate and the center portion of the napkin stack. Accordingly, the friction between each napkin is substantially reduced, thereby permitting individual napkins to be withdrawn from the dispenser without displacing napkins remaining in the stack.

13 Claims, 19 Drawing Figures

DEVICE FOR PREVENTING NAPKINS FROM BUNCHING AT THE DISPENSING OPENING IN A PAPER NAPKIN DISPENSER

BACKGROUND OF THE INVENTION

The present invention relates to the field of paper napkin dispensers, and more particularly, is directed to a device for preventing napkins from bunching at the dispensing opening.

A conventional napkin dispenser comprises a housing with at least one compartment for receiving a stack of napkins and a face plate having a dispensing opening. Each stack of napkins is fed forwardly by a spring biased follower plate which maintains the stack in pressure contact with the face plate and dispensing opening. As napkins are pulled from the dispenser, the follower plate advances the napkin stack forward until the supply of napkins is exhausted. While napkin dispensers of this type have the virtue of simple and economical manufacture, they have proved inefficient in practical applications.

One of the major disadvantages of napkin dispensers of the type described above has chiefly to do with the problem of napkins bunching at the dispensing opening. When bunching occurs, there is a tendency for the user to grasp and remove the entire group of bunched napkins, wastefully discarding what is not used. In fast food restaurants, cafeterias and the like, where there are large numbers of users, the cost of wasteful use of napkins is very high.

Bunching is believed to occur as a result of the high level of pressure exerted by the dispenser face plate on the napkin stack. When a napkin is pulled from the dispenser, there is a tendency for the next several napkins to be displaced as well due to the friction between them caused by the pressure. The problem becomes progressively worse as more napkins are pulled from the dispenser, thus leading to a bunching condition. When bunching occurs, it is difficult to pull a single napkin from the dispenser without tearing. Thus, the user will likely remove the entire group of bunched napkins and discard what is not needed.

SUMMARY OF THE INVENTION

It is therefore the overall object of the present invention to overcome the above-noted disadvantages and deficiencies of conventional napkin dispensers by providing a device which substantially and effectively prevents napkins from bunching at the dispensing opening.

A specific object of the present invention is to provide such a device which can be easily manufactured and installed along with the fabrication of the dispenser.

A further specific object of the present invention is to provide such a device which is economical to manufacture and which does not interfere with the ease of operation of the dispenser.

It has been found that the bunching problem associated with conventional napkin dispensers can be overcome or significantly eliminated by reducing the level of pressure between the dispenser face plate and the napkin stack. Thus, the friciton between adjacent napkins is substantially reduced and there is less likelihood that the next several napkins will be displaced when a napkin is pulled from the dispenser.

While a reduction in the pressure level between the dispenser face plate and the napkin stack can be accomplished by reducing the spring tension on the follower plate, this would create other problems such as the lower part of the napkin stack not being sufficiently fed forward to the dispensing opening. It has been discovered that the level of pressure can be reduced without causing any adverse effects by the addition of a pair of opposed pressure relief rods mounted adjacent the inside surface of the face plate. The face plate is also made slightly outwardly concave. As the napkin stack is fed forward by the operation of the follower plate, the top and bottom edges of the stack contact the pressure relief rods. Thus, the central or center portion of the napkin stack can freely bow toward the concave face plate. Ideally, the center portion of the stack does not touch the face plate and if at all, only slightly. Thus, substantially all of the pressure on the stack is relieved. Accordingly, napkins pulled from the dispenser are progressively stripped along their edges from the pressure relief rods without disturbing the next several napkins in the stack.

BRIEF DESCRIPTION OF THE DRAWINGS

The novel features of the present invention are set forth with particularity in the appended claims. The invention, however, will be understood more fully from the following detailed description in conjunction with the accompanying drawings, in which:

DETAILED DESCRIPTION OF THE PREFERRED EMBODIMENT

Figure 1:
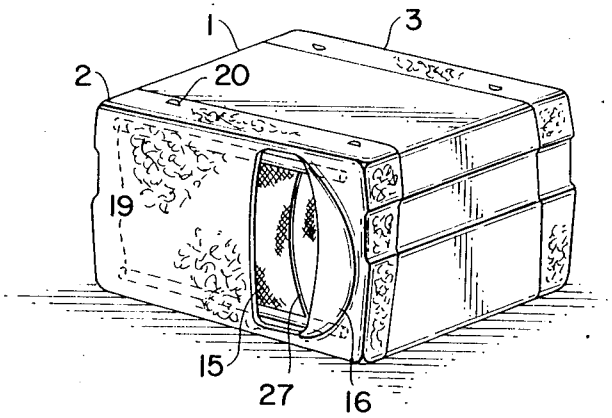
FIG. 1 is a front perspective view of a napkin dispenser incorporating pressure relief rods in accordance with the present invention.

A napkin dispenser which incorporates a device for preventing bunching at the dispensing opening in accordance with the present invention is shown in FIG. 1. It should be understood that the dispenser shown in FIG. 1 is presented merely as an example of one application of the present invention. It is anticipated that the invention may be used in virtually any napkin dispenser where a napkin stack is fed forward to a face plate having a dispensing opening. It is also anticipated that the present inventin is applicable to napkin dispensers having one or a plurality of compartments for receiving a napkin stack for respective dispensing openings.

Figure 2:
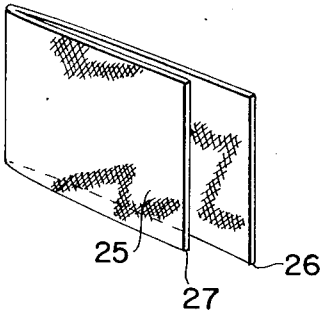
FIG. 2 is a front perspective view of a two-ply paper napkin used in the dispenser shown in FIG. 1.
Figure 17:
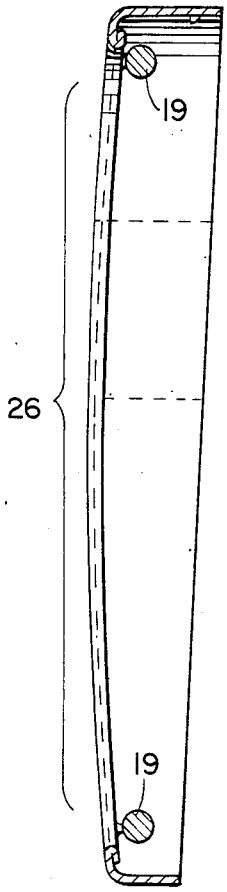
FIG. 17 is a sectional view taken along line 17—17 in FIG. 15.
Figure 18:
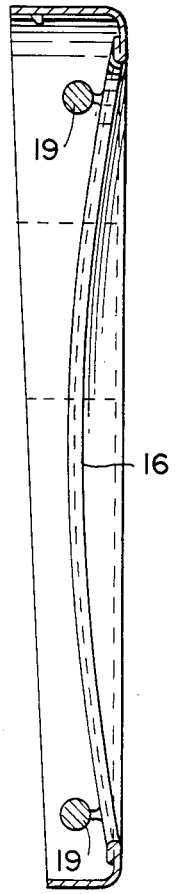
FIG. 18 is a sectional view taken along line 18—18 in FIG. 15.

As shown in FIG. 1, the dispenser comprises housing 1 (separately illustrated in FIGS. 5–8) and face plates 2 and 3 (separately illustrated in FIGS. 15–18). Face plates 2 and 3 are identical in construction. Thus, for the purpose of simplicity, the following description will refer only to face plate 2. It should be understood, however, that the description hereafter given is fully applicable to face plate 3 as well. Face plate 2 comprises dispensing opening 15 through which a napkin can be withdrawn from the dispenser and a debossed area 16. As shown in FIG. 18, debossed area 16 is inwardly concave to facilitate withdrawal of a napkin as will be explained below with reference to the napkin shown in Figure 2.

Figure 4:
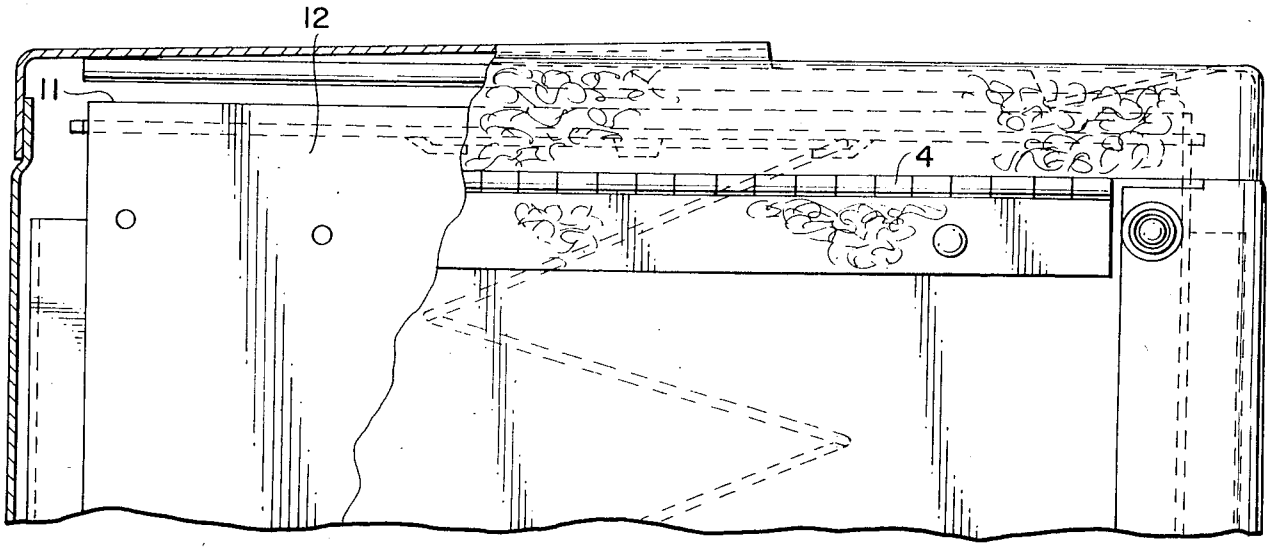
FIG. 4 is a fragmentary bottom view partially in section of the napkin dispenser shown in FIG. 1 illustrating the face plate hinge means.
Figure 3:
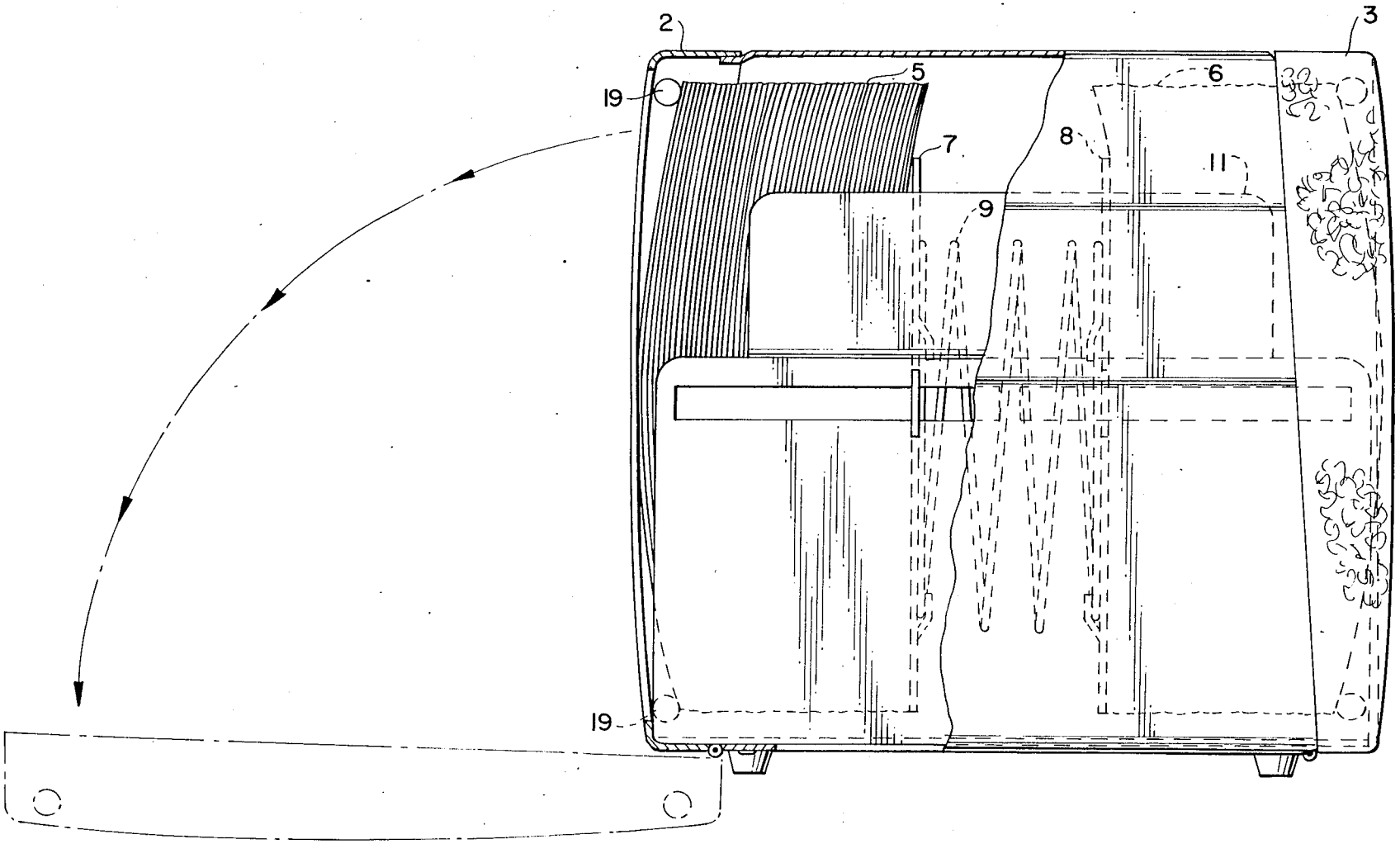
FIG. 3 is a side view partially in section of the napkin dispenser shown in FIG. 1 illustrating the spring biased follower plate and the operation of the face plate.
Figure 5:
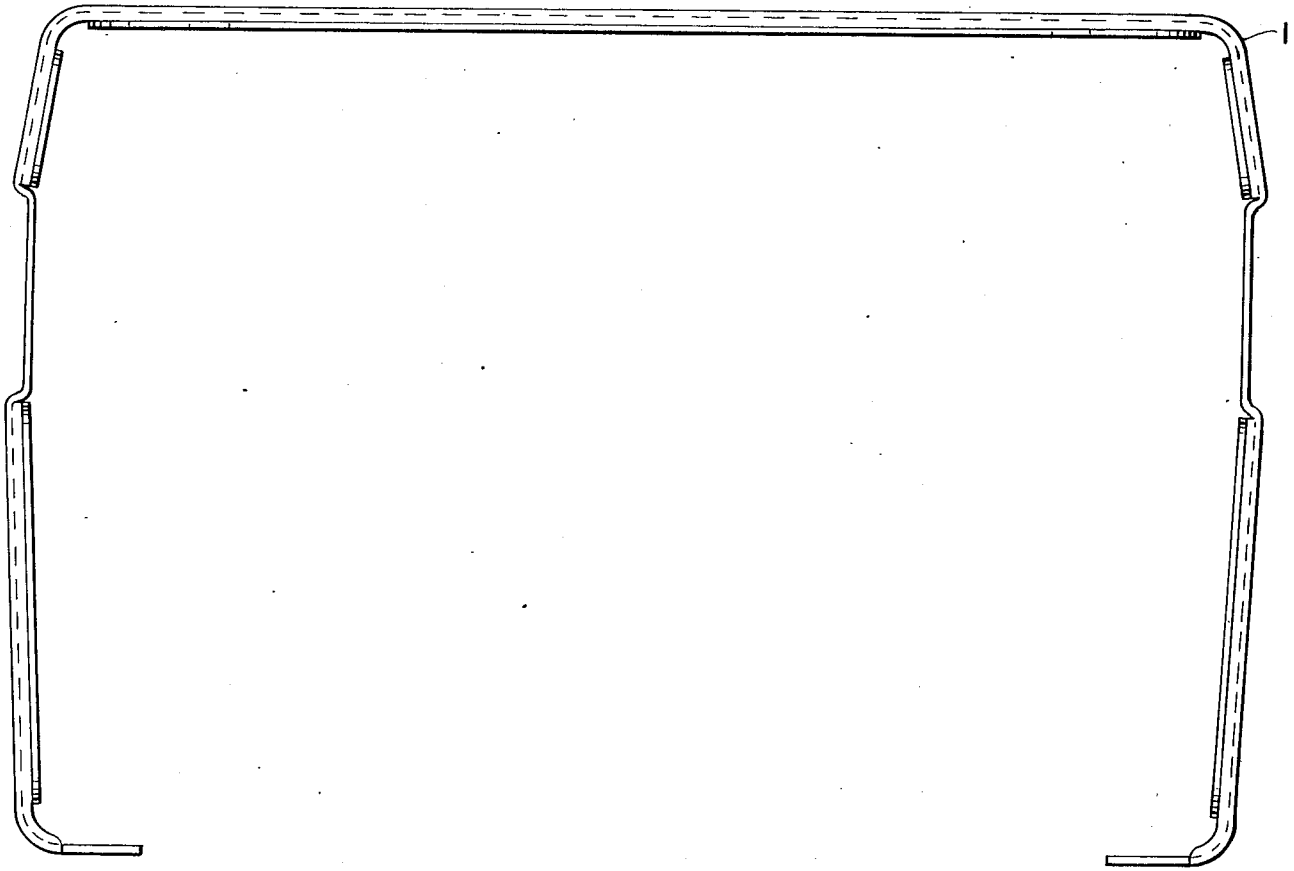
FIG. 5 is a front view of the housing for the napkin dispenser shown in FIG. 1.
Figure 7:
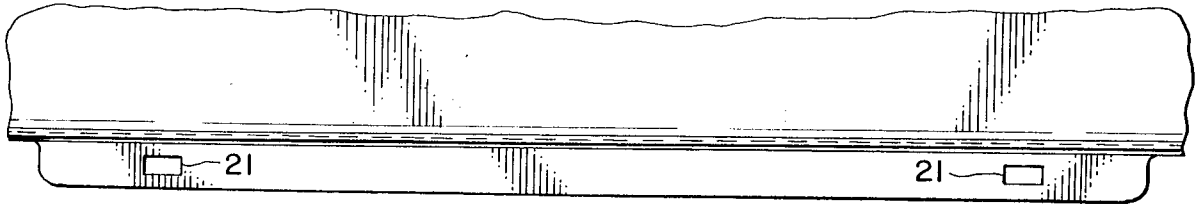
FIG. 7 is a partial top view of the housing shown in FIG. 5.
Figure 8:
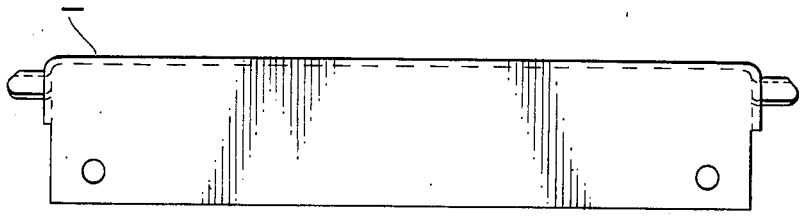
FIG. 8 is a bottom view of one end of the housing shown in FIG. 5.
Figure 6:
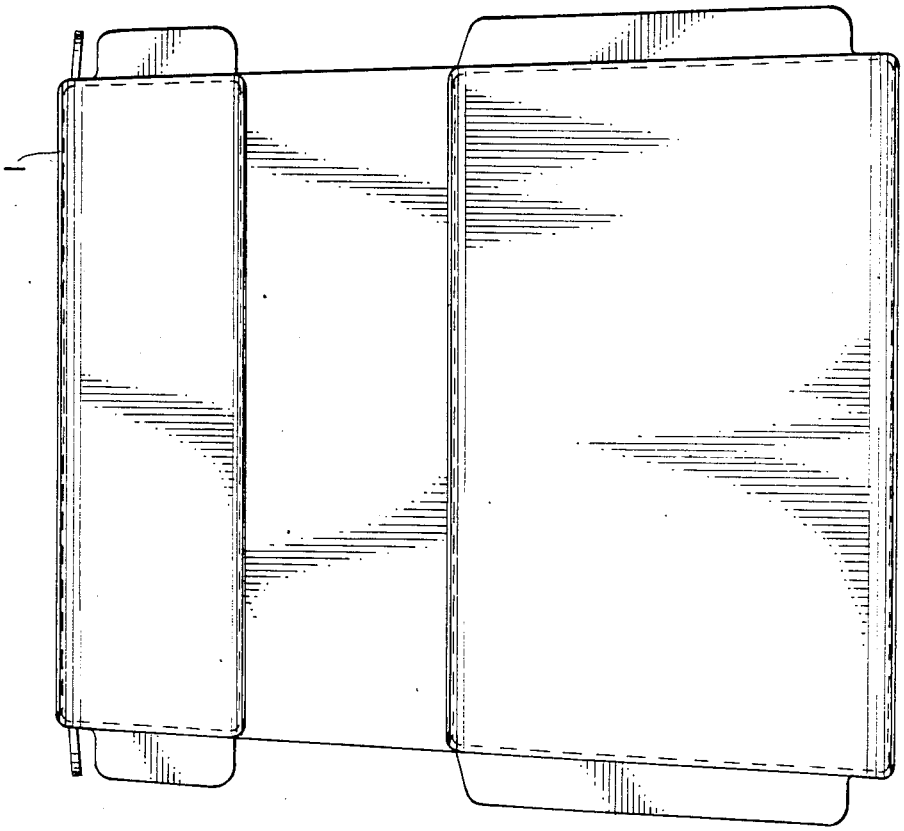
FIG. 6 is a side view of the housing shown in FIG. 5.
Figure 9:
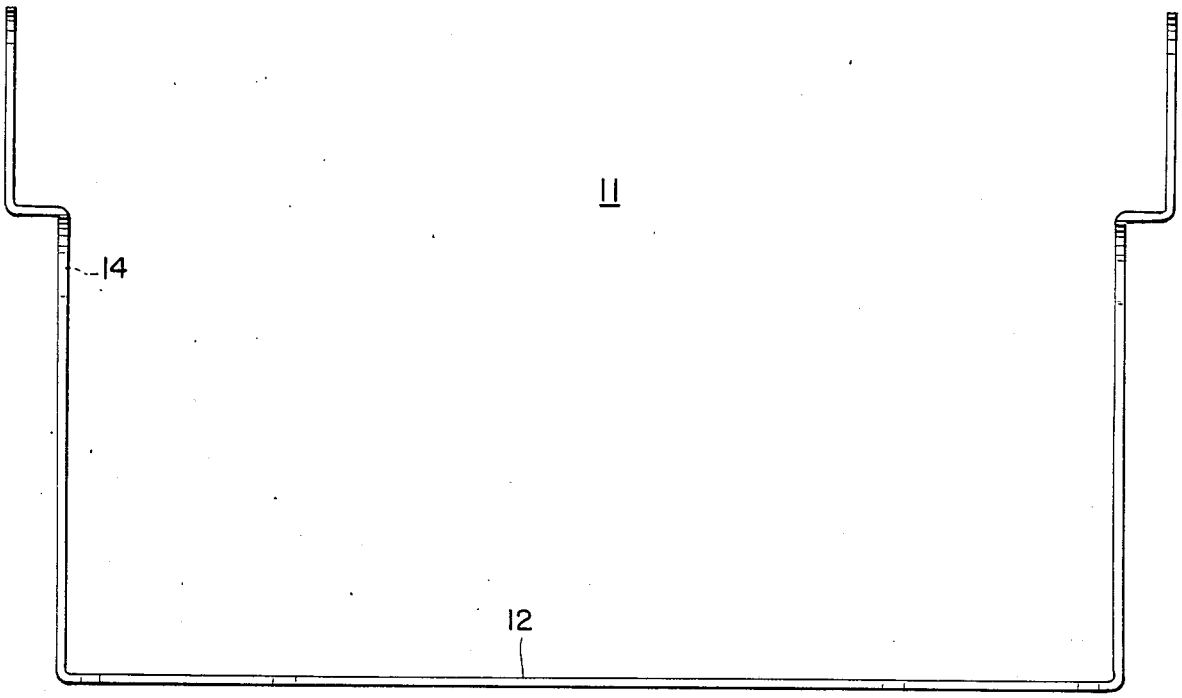
FIG. 9 is a front view of the internal support frame for the napkin dispenser shown in FIG. 1.
Figure 10:
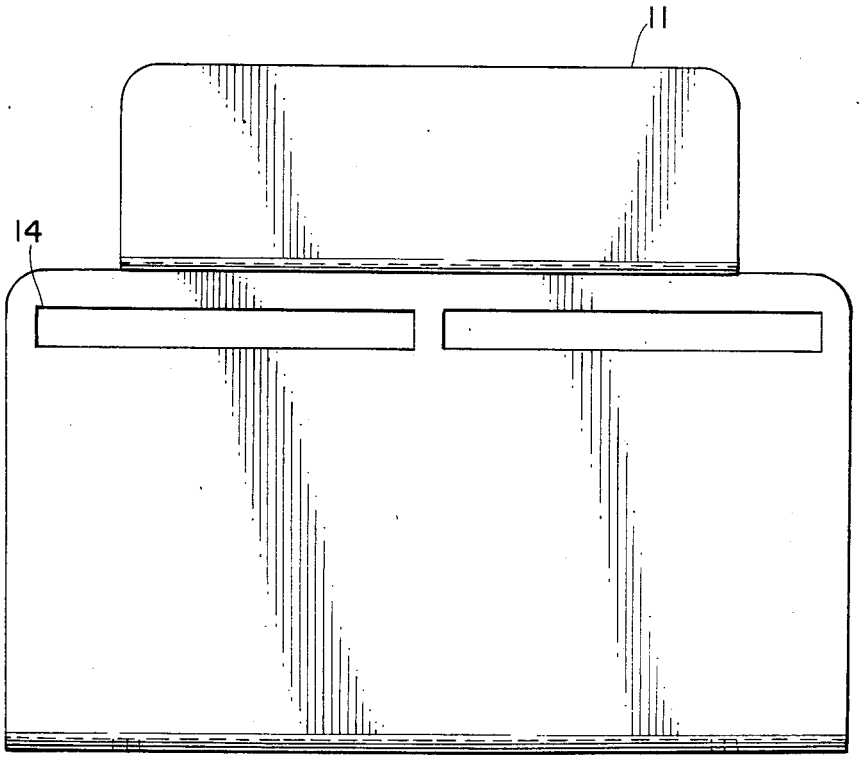
FIG. 10 is a side view of the internal support frame shown in FIG. 9 illustrating the slots which support the spring biased follower plates.
Figure 11:
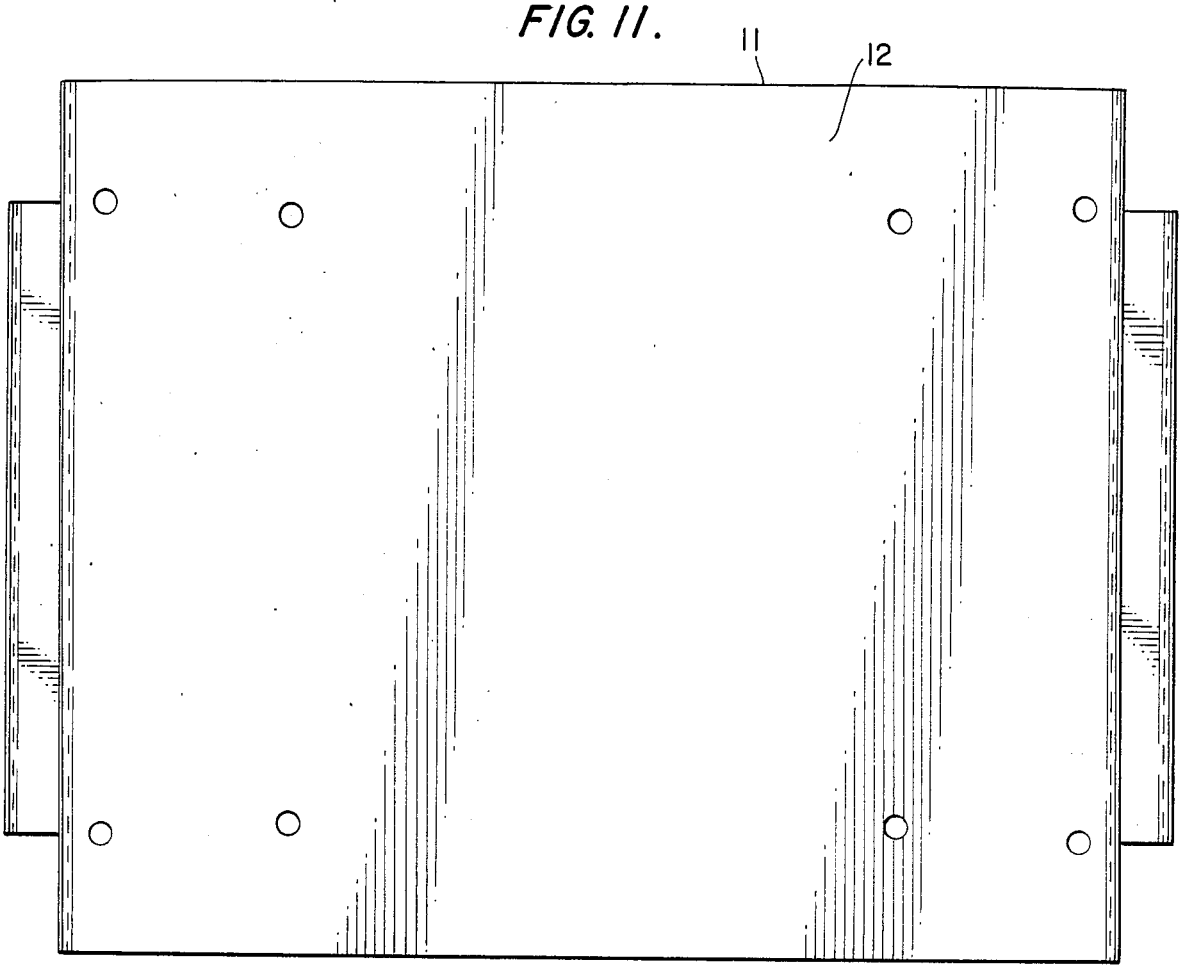
FIG. 11 is a bottom view of the internal support frame shown in FIG. 9.

Also comprising the dispenser shown in FIG. 1 is frame support 11 shown in FIGS. 9–11. Surface 12 of frame support 11 forms the bottom of the dispenser and also provides a surface for hingibly attaching face plate 2 via hinge 4 shown in FIG. 4. Thus, face plate 2 may be opened as shown in FIG. 3 to fill the dispenser with a supply of napkins 5 and 6. Face plate 2 is maintained closed by snap members 20 shown in some detail in FIG. 1 and in more detail in FIGS. 15 and 16. Snap members 20 are received in slots 21 along the top edge of housing 1 as shown in FIG. 7.

Figure 12:
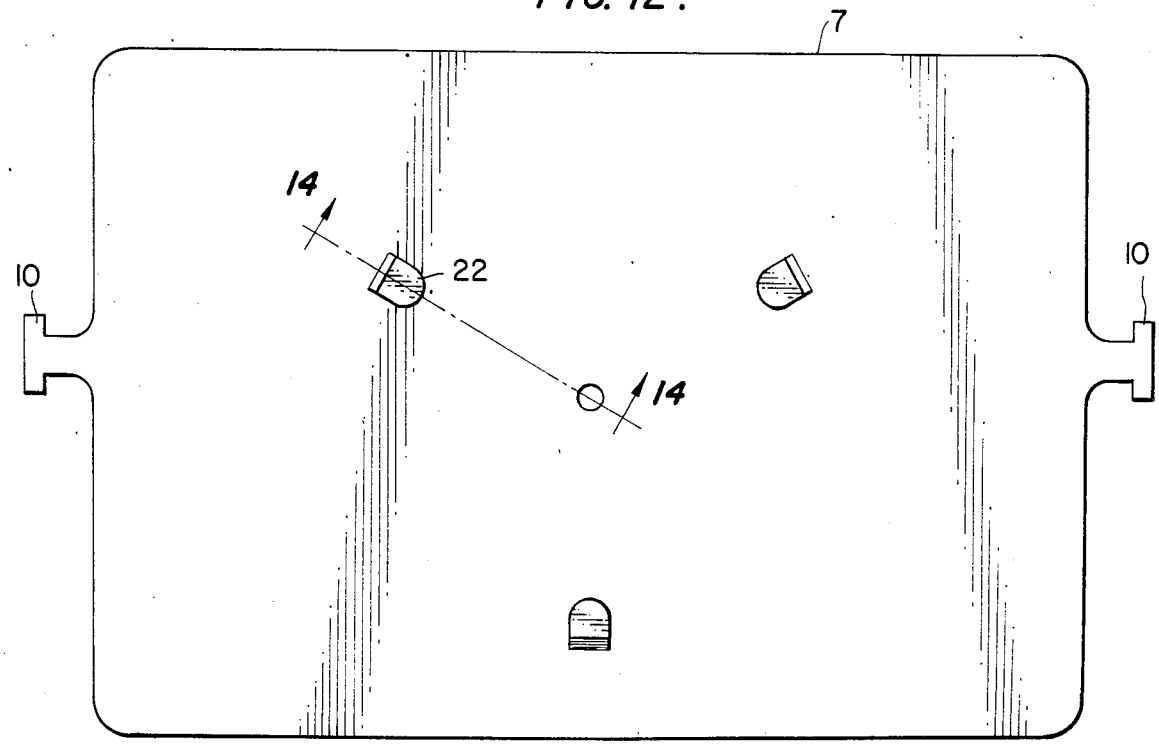
FIG. 12 is a front view of the spring biased follower plate for the napkin dispenser shown in FIG. 1.
Figure 13:
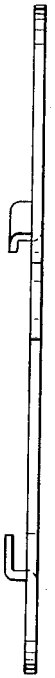
FIG. 13 is a side view of the spring biased follower plate shown in FIG. 12.
Figure 14:
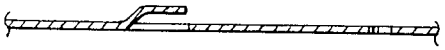
FIG. 14 is a sectional view taken along line 14—14 in FIG. 12 showing the tabs used to retain the spring biasing means to the follower plate shown in FIG. 12.

With reference to FIG. 3, follower plates 7 and 8 are provided within housing 1 and are biased by spring 9 to forwardly feed napkin stacks 5 and 6 toward their respective face plates. Follower plates 7 and 8 are also identical in construction as shown in FIGS. 12–14. For the purpose of simplicity, only follower plate 7 will be described with the understanding that the description hereafter given is fully applicable to follower plate 8 as well. As shown in FIG. 12, follower plate 7 includes guide tabs 10 which engage slots 14 in frame support 11 shown in FIG. 10. Tabs 10 and slots 14 define the path of travel of follower plate 7 in housing 1.

Thus far described, the napkin dispenser shown in FIG. 1 is typical of most dispensers known in the prior. Such dispensers are designed to use a multi-ply folded napkin of the type shown in Figure 2. Napkins of this type usually have a short flap 25 and a long flap 26. The napkin stack is positioned in the dispenser with short flap 25 of the napkin forward with its end 27 visible in dispensing opening 15 and presented to the user so that it may be readily grasped. Debossed area 16 facilitates grasping of end 27. The corresponding edge of flap 26 extends beyond dispensing opening 15, thereby effectively sealing off the opening to prevent dirt and other contaminants from entering the dispenser. In the conventional napkin dispenser, the napkin stack is fed forward by the action of the follower plate to maintain the stack in pressure contact with the dispenser face plate. As explained above, however, high levels of pressure on the napkin stack leads to a bunching condition at the dispensing opening when napkins are pulled from the dispenser. The bunching condition is eliminated by the present invention with the addition of pressure relief means comprising a pair of rods mounted adjacent the face plate and an outwardly concave depression of the face plate.

Figure 15:
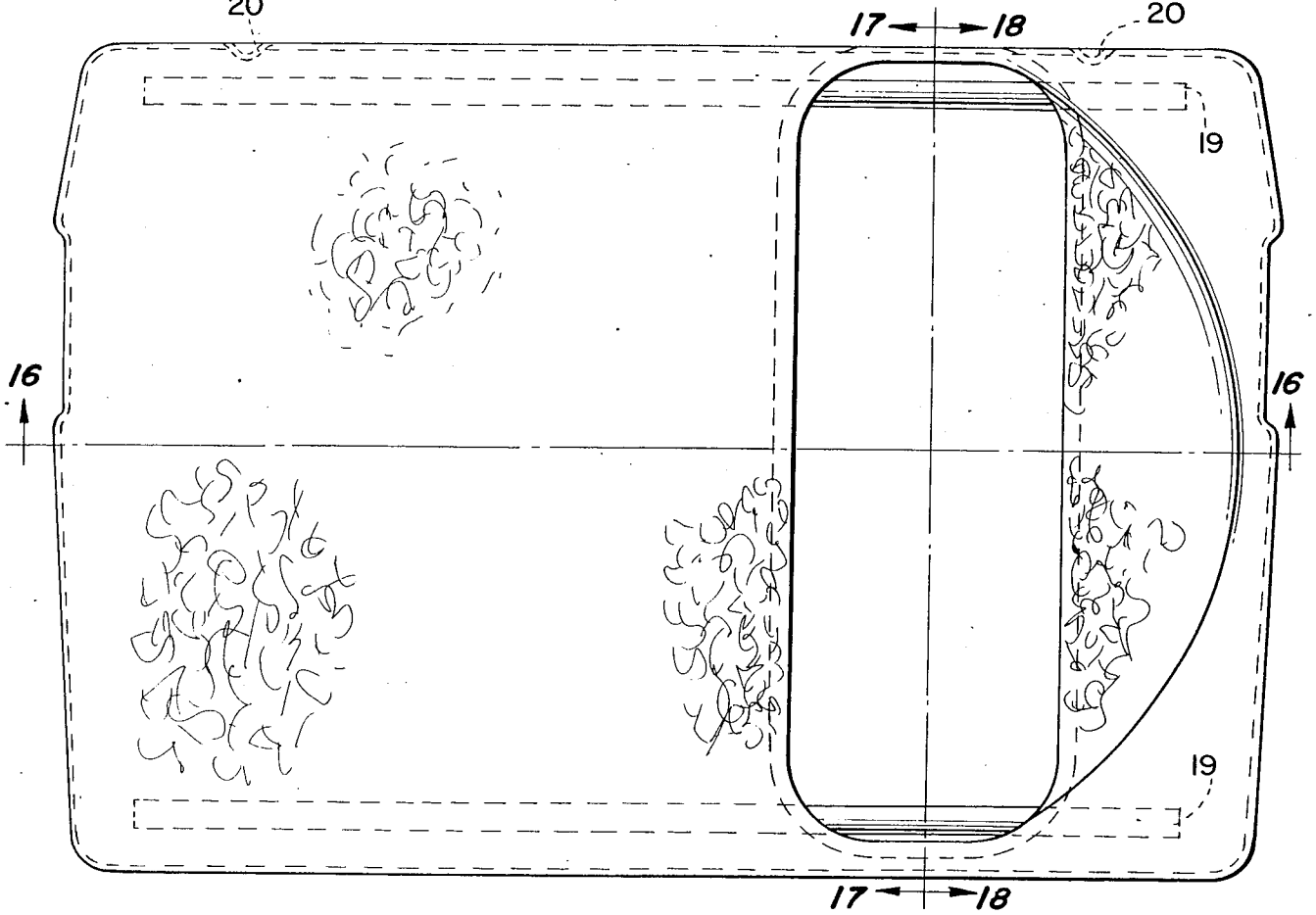
FIG. 15 is a front view of a napkin dispenser face plate in accordance with the present invention.
Figure 16:
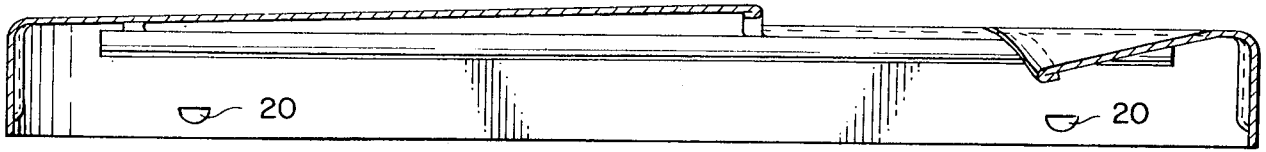
FIG. 16 is a sectional view taken along line 16—16 in FIG. 15.

With reference to FIG. 1 and 15, pressure relief rods 19 are shown attached in parallel position along the upper and lower portions of face plate 2. Rods 19 may be attached to face plate 2 by any convenient attachment means known in the prior art such as welding or adhesive bonding. With reference to FIG. 17, note that face plate 2 is outwardly concave over portion 26.

Figure 19:
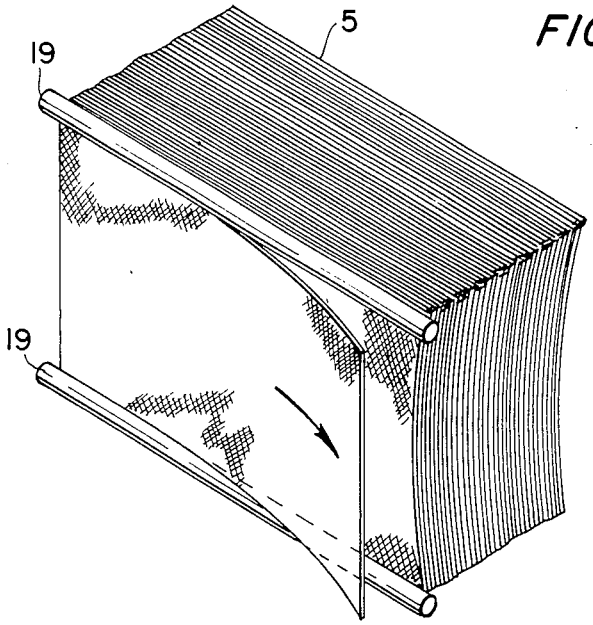
FIG. 19 is a front perspective view of a napkin stack showing the operation of the pressure relief rods in accordance with the present invention.

With reference to FIGS. 3 and 19, the operation of the present invention will now be explained. As shown in FIG. 3, when napkin stack 5 is positoned in the dispenser, the stack is fed forward against pressure relief rods 19 by the operation of follower plate 7. Rods 19 contact napkin stack 5 along its upper and lower edges only and maintains said contact continuously along substantially the entire length of the edge. The central or center position of stack 5 is permitted to bow outwardly toward concave face plate 2. Ideally, the center portion of napkin stack 5 should not touch face plate 2, and if at all, only slightly. Accordingly, there is little, if any, pressure exerted by face plate 2 on the napkin stack. As a napkin is pulled from the dispenser, it is progressively stripped along both edges from pressure relief rods 19 as shown in FIG. 19. Thus, the next several napkins in the stack are not displaced, thereby eliminating the bunching condition in the dispensing opening associated with conventional dispensers.

The present invention, therefore, provides a napkin dispenser that is much more efficient and cost effective to operate than napkin dispensers known in the prior art. Napkins can be repeatedly withdrawn from the dispenser without bunching. Thus, there is little likelihood that a napkin will become tangled and the user wastefully grasping and removing a group of napkins.

Many modifications and variations of the above-described preferred embodiment may become apparent to those skilled in the art. It should be realized that the invention is not limited to the particular device disclosed, but its scope is intended to be governed only by the scope of the appended claims.

I claim:

1. In a napkin dispenser having at least one face plate with a generally elongated dispensing opening and pressure exerting means for urging a napkin stack with two opposed edges and a further edge perpendicular to said two opposed edges toward said face plate, said further edge disposed adjacent said dispensing opening, a device for substantially preventing napkins from bunching at said dispensing opening when napkins are successively withdrawn from said dispenser, said device comprising pressure relief means mounted adjacent said face plate to engage said napkin stack only along a substantial length of said two opposed edges thereof for reducing the level of pressure exerted by said face plate on the center portion of said napkin stack, wherein said presure relief means is positioned with respect to said face plate, said napkin stack and said discharge opening such that when further edge of a napkin is pulled from said discharge opening the edges of the napkin which form said two opposed edges of said napkin stack are progressively stripped from said pressure relief means simultaneously.

2. The device of claim 1 wherein said pressure relief means comprises first and second rod members mounted adjacent respective upper and lower portions of said face plate.

3. The device of claim 1 wherein said face plate is outwardly concave to receive the center portion of the napkin stack.

4. The device of claim 1 wherein said pressure relief means is mounted perpendicular to the plane of said dispenser which contains said dispensing opening.

5. The device of claim 4 wherein said pressure relief means comprises first and second cylindrical members.

6. A napkin dispenser for dispensing paper napkins, said dispenser comprising:

a housing with at least one compartment for receiving a napkin stack with two opposed edges and a further edge perpendicular to said two opposed edges;

a face plate cooperating with said compartment and having a generally elongated dispensing opening, said further edge disposed adjacent said dispensing opening;

pressure exerting means within said compartment for urging said napkin stack toward said face plate; and pressure relief means mounted adjacent said face plate for reducing the level of pressure exerted by said face plate on the center portion of said napkin stack, wherein said pressure relief means engages only said two opposed edges of said napkin stack, wherein said pressure relief means is positioned with respect to said face plate, said napkin stack and said discharge opening such that when said further edge of a napkin is pulled from said discharge opening the edges of the napkin which from said two opposed edges of said napkin stack are progressively stripped from said pressure relief means simultaneously.

7. The napkin dispenser of claim 6 wherein said pressure relief means comprises first and second rod members mounted adjacent respective upper and lower portions of said face plate.

8. The napkin dispenser of claim 6 wherein said face plate is outwardly concave to receive the center portion of the napkin stack.

9. The napkin dispenser of claim 6 wherein said pressure relief means engages the napkin stack along a substantial length of said two opposed edges.

10. The device of claim 6 wherein said pressure relief means is mounted perpendicular to the plane of said dispenser which contains said dispensing opening.

11. The device of claim 10 wherein said pressure relief means comprises first and second cylindrical members.

12. In a napkin dispenser having at least one face plate with a dispensing opening and pressure exerting means for urging a napkin stack with two opposed edges toward said face plate, a device for substantially preventing napkins from bunching at said dispensing opening when napkins are successively withdrawn from said dispenser, said device comprising pressure relief means mounted adjacent said face plate to engage said napkin stack only along a substantial length of said two opposed edges thereof for reducing the level of pressure exerted by said face plate on the center portion of said napkin stack, and a further edge perpendicular to said two opposed edges, said further edge disposed adjacent said dispensing opening, wherein said pressure relief means is positioned with respect to said face plate, said napkin stack and said discharge opening such that when said further edge of a napkin is pulled from said discharge opening the edges of the napkin which form said two opposed edges of said napkin stack are progressively stripped from said pressure relief means simultaneously.

13. A napkin dispenser for dispensing paper napkins, said dispenser comprising:

a housing with at least one compartment for receiving a napkin stack with two opposed edges and a further edge perpendicular to said two opposed edges;

a face plate cooperating with said compartment and having a dispensing opening, said further edge disposed adjacent said dispensing opening;

pressure exerting means within said compartment for urging said napkin stack toward said face plate; and pressure relief means mounted adjacent said face plate for reducing the level of pressure exerted by said face plate on the center portion of said napkin stack, wherein said pressure relief means engages only said two opposed edges of said napkin stack, wherein said pressure relief means is positioned with respect to said face plate, said napkin stack and said discharge opening such that when said further edge of a napkin is pulled from said discharge opening the edges of the napkin which form said two opposed edges of said napkin stack are progressively stripped from said pressure relief means simultaneously.

* * * * *